US009820569B2

(12) United States Patent
Tsai

(10) Patent No.: US 9,820,569 B2
(45) Date of Patent: Nov. 21, 2017

(54) MULTI-GAME TABLE

(71) Applicant: Medal Sports (Taiwan) Corporation, Taipei (TW)

(72) Inventor: Kevin Chunhao Tsai, Kaohsiung (TW)

(73) Assignee: Medal Sports (Taiwan) Corporation, Taipei (TW)

( * ) Notice: Subject to any disclaimer, the term of this patent is extended or adjusted under 35 U.S.C. 154(b) by 0 days.

(21) Appl. No.: 14/928,558

(22) Filed: Oct. 30, 2015

(65) Prior Publication Data

US 2016/0325163 A1 Nov. 10, 2016

Related U.S. Application Data

(63) Continuation-in-part of application No. 29/526,394, filed on May 8, 2015, now Pat. No. Des. 770,567.

(51) Int. Cl.

| | |
|---|---|
| ***A63F 9/00*** | (2006.01) |
| ***A47B 25/00*** | (2006.01) |
| ***A63B 67/02*** | (2006.01) |
| ***A63F 3/00*** | (2006.01) |
| ***A63F 7/06*** | (2006.01) |

(52) U.S. Cl.

CPC ..... *A47B 25/00* (2013.01); *A63B 67/02* (2013.01); *A63F 3/00214* (2013.01); *A63F 3/00533* (2013.01); *A63F 7/06* (2013.01); *A63F 7/0672* (2013.01); *A63B 2243/002* (2013.01); *A63F 2003/00217* (2013.01)

(58) Field of Classification Search

CPC ..... A63B 67/02; A63B 67/04; A47B 25/00; A63F 3/00214; A63F 3/00533; A63F 7/06; A63F 7/0672

USPC ..... 273/309, 280, 287

See application file for complete search history.

(56) References Cited

U.S. PATENT DOCUMENTS

| | | | | | |
|---|---|---|---|---|---|
| 164,641 | A * | 6/1875 | Draper | A63F 7/3065 | 273/127 R |
| 1,534,522 | A * | 4/1925 | Halliday | A63F 7/305 | 273/118 D |
| 1,712,561 | A * | 5/1929 | Jaspert | A63B 57/40 | 273/127 D |
| 1,870,536 | A * | 8/1932 | Vaccaro, Jr. | A63B 67/02 | 473/158 |
| 1,971,612 | A * | 8/1934 | Kidwell | A47G 33/045 | 446/118 |
| 1,973,492 | A * | 9/1934 | Linero | A63D 15/00 | 473/25 |

(Continued)

*Primary Examiner* — Vishu Mendiratta

(74) *Attorney, Agent, or Firm* — Honigman Miller Schwartz and Cohn LLP

(57) ABSTRACT

The present disclosure relates to a multi-game table apparatus and includes a table, with a surface panel configured for a table game. The apparatus further includes at least two table legs, with a top end and a bottom end. The top end of each table leg is connected to the table. The bottom end of each table leg is configured to contact a floor. The apparatus further includes a cross support beam, with a first end and a second end. The first end is connected to one of the table legs. The second end is connected to another of the table legs. The apparatus further includes a miniature golf course, underneath the table. The miniature golf course includes a miniature golf hole that is configured such that a portion of the cross support beam is an element of the miniature golf hole.

8 Claims, 7 Drawing Sheets

(56) References Cited

U.S. PATENT DOCUMENTS

| | | | | | |
|---|---|---|---|---|---|
| 2,383,866 | A * | 8/1945 | Kling | A63B 57/40 | 273/127 B |
| 2,427,434 | A * | 9/1947 | Whitehouse | A63F 7/305 | 273/127 D |
| 2,719,719 | A * | 10/1955 | Sherwan | A63B 57/357 | 473/183 |
| 2,849,238 | A * | 8/1958 | Eldredge | A63B 67/02 | 273/127 B |
| 3,817,535 | A * | 6/1974 | Doughty | A63F 7/305 | 473/185 |
| 4,026,556 | A * | 5/1977 | Taylor | A63D 5/00 | 273/118 R |
| 4,185,832 | A | 1/1980 | Traficante | | |
| 4,203,604 | A * | 5/1980 | La Grange | A63B 69/3661 | 273/DIG. 13 |
| 4,761,009 | A * | 8/1988 | Gibree | A63B 63/00 | 473/183 |
| D317,945 | S | 7/1991 | McNaull | | |
| 5,029,861 | A | 7/1991 | Driska | | |
| 5,154,426 | A * | 10/1992 | Black | A63B 67/02 | 273/127 D |
| 5,181,721 | A * | 1/1993 | Halliburton | A63B 63/00 | 273/378 |
| 5,354,062 | A * | 10/1994 | Lenger | A63B 57/405 | 211/70.2 |
| 5,472,189 | A * | 12/1995 | Pfeiffer | A63B 67/04 | 221/155 |
| D382,601 | S | 8/1997 | Antill | | |
| D392,334 | S | 3/1998 | Taylor | | |
| 6,155,564 | A | 12/2000 | Tsai | | |
| 6,502,819 | B2 | 1/2003 | Rieber et al. | | |
| 6,766,747 | B1 | 7/2004 | Wolfe | | |
| D495,531 | S | 9/2004 | Allshouse et al. | | |
| 6,846,243 | B2 * | 1/2005 | Francisco | A63B 67/002 | 273/118 R |
| 7,108,262 | B2 | 9/2006 | Giegerich | | |
| 7,901,290 | B2 | 3/2011 | Temple | | |
| 7,980,627 | B2 * | 7/2011 | Arias | A47B 3/14 | 297/157.1 |
| 8,764,542 | B2 | 7/2014 | Cram | | |
| 2003/0130051 | A1 * | 7/2003 | Pearson | A63D 15/00 | 473/10 |

* cited by examiner

MULTI-GAME TABLE

PRIORITY CLAIM

The present application claims the benefit of U.S. Design patent application Ser. No. 29/526,394 filed on May 8, 2015, the entirety of which is incorporated herein by reference.

BACKGROUND

Traditional game tables are limited in a number of ways. For instance, game tables are limited structurally: the tables are, more often than not, configured solely for one particular game. Game tables are also limited by the nature of the particular game: the user is not able to play other kinds of games on a particularly configured table. Moreover, particular game configurations are often associated with games that a user may characterize as unenjoyable, old-fashioned, and boring. With structural limitations, it is difficult, if not impossible, for the user to modify a game table for enjoyable, creative, and new types of games. Likewise, it is difficult, if not impossible, for the user to envision combining different game sets to create entirely new games, with entirely new sets of rules.

Additionally, game tables are often in locations where floor space is at a premium. In bars, restaurants, home basements, and the like, the user does not want any game tables or variations of game tables occupying too much floor space. Due to space restrictions, the user may have to settle for one particular game configuration. Furthermore, while some manufacturers do offer multi-game tables (e.g., 6-in-1 or 20-in-1 table games) these games are limited to the top surface panel of the table itself.

SUMMARY

The present disclosure relates generally to a multi-game table apparatus. More particularly, the multi-game table apparatus enables a user to play two different games, a table game and a miniature golf game, on the same table apparatus. The two different games can be played simultaneously, for creative variations of current games. Likewise, the two different games have a reduced footprint.

In an example embodiment, a table game apparatus includes a table including a surface panel configured for a table game. The table game apparatus further includes at least two table legs including a top end and a bottom end, the top end of each table leg connected to the table and the bottom end of each table leg configured to contact a floor. The table game apparatus further includes a cross support beam including a first end and a second end, the first end connected to one of the table legs and the second end connected to another of the table legs. The table game apparatus further includes a miniature golf course located underneath the table and configured to contact the floor, the miniature golf course including a miniature golf hole configured such that a portion of the cross support beam is an element of the miniature golf hole.

In a different example embodiment, a table game apparatus includes a table including a surface panel configured with a number of table holes. The table game apparatus further includes at least two table legs including a top end and a bottom end, the top end of each table leg connected to the table and the bottom end of each table leg configured to contact a floor. The table game apparatus further includes a cross support beam including a first end and a second end, the first end connected to one of the table legs and the second end connected to another of the table legs. The table game apparatus further includes a miniature golf course located underneath the table and configured to contact the floor, the miniature golf course including a miniature golf hole configured such that a portion of the cross support beam is an element of the miniature golf hole. The table game apparatus further includes a ball delivery system that includes a chute, disposed below one of the plurality of table holes, wherein the chute is in communication with both the one of the plurality of table holes and a location below the surface panel.

Additional features and advantages of the disclosed method and apparatus are described in, and will be apparent from, the following Detailed Description and the Figures.

BRIEF DESCRIPTION OF THE FIGURES

The features, objects, and advantages of the present disclosure will become more apparent from the detailed description set forth below when taken in conjunction with the drawings in which like reference characters identify correspondingly throughout and wherein.

DETAILED DESCRIPTION

A benefit of the example multi-game table disclosed herein is the reduced footprint for the play of two or more games at different elevations. In locations where floor space is considered a premium (e.g., bars, restaurants, home basements, etc.), the user does not want any game tables or variations of game tables taking up too much floor space. As disclosed, a miniature golf course is located underneath the table, utilizing floor space that is already limited and defined by the table, table legs, cross support beams, etc. Moreover, in particular example embodiments, the miniature golf course is entirely disposed between the cross support beams. For at least these reasons, use of the example multi-game table disclosed herein gives the user an opportunity to have multiple games on the same floor space. The user no longer has to settle for one particular game configuration.

By providing a miniature golf course, disposed below the table, the user is able to play two separate games, with one table, simultaneously. By comparison, a user with a traditional 6-in-1 table game can play six different games, but only one at a time; the user is required to modify the table each time the user wants to play a new game. Furthermore, and as disclosed, the miniature golf course is configured such that a portion of the multi-game table (e.g., the cross support beam, stationary physical hazards, moving physical hazards, etc.) is an element of a miniature golf hole on the miniature golf course. In this sense, two separate games are integrated into one multi-game table. By providing multiple games to the user on the same table, the user can effectively get two games from one table; the user no longer has to settle for one particular game configuration.

Another benefit of the multi-game table is the fact that the two separate games, integrated into one multi-game table, can result in new combination-type games. Traditional game tables are typically limited structurally and configured solely for one particular game. Game tables are also limited by the nature of the particular game. Moreover, particular game configurations are often associated with games that the user may characterize as unenjoyable, old-fashioned, and boring. Integration of separate games into one multi-game table can provide additional variety to the user. For example, the table can provide at least three separate games: the table game (e.g., billiards, foosball, etc.), the miniature golf game, and a combination game of both the table game and the miniature golf game. This combination game can provide new game types to the user; the combination game can also provide new rule sets to existing table games.

Figure 1:
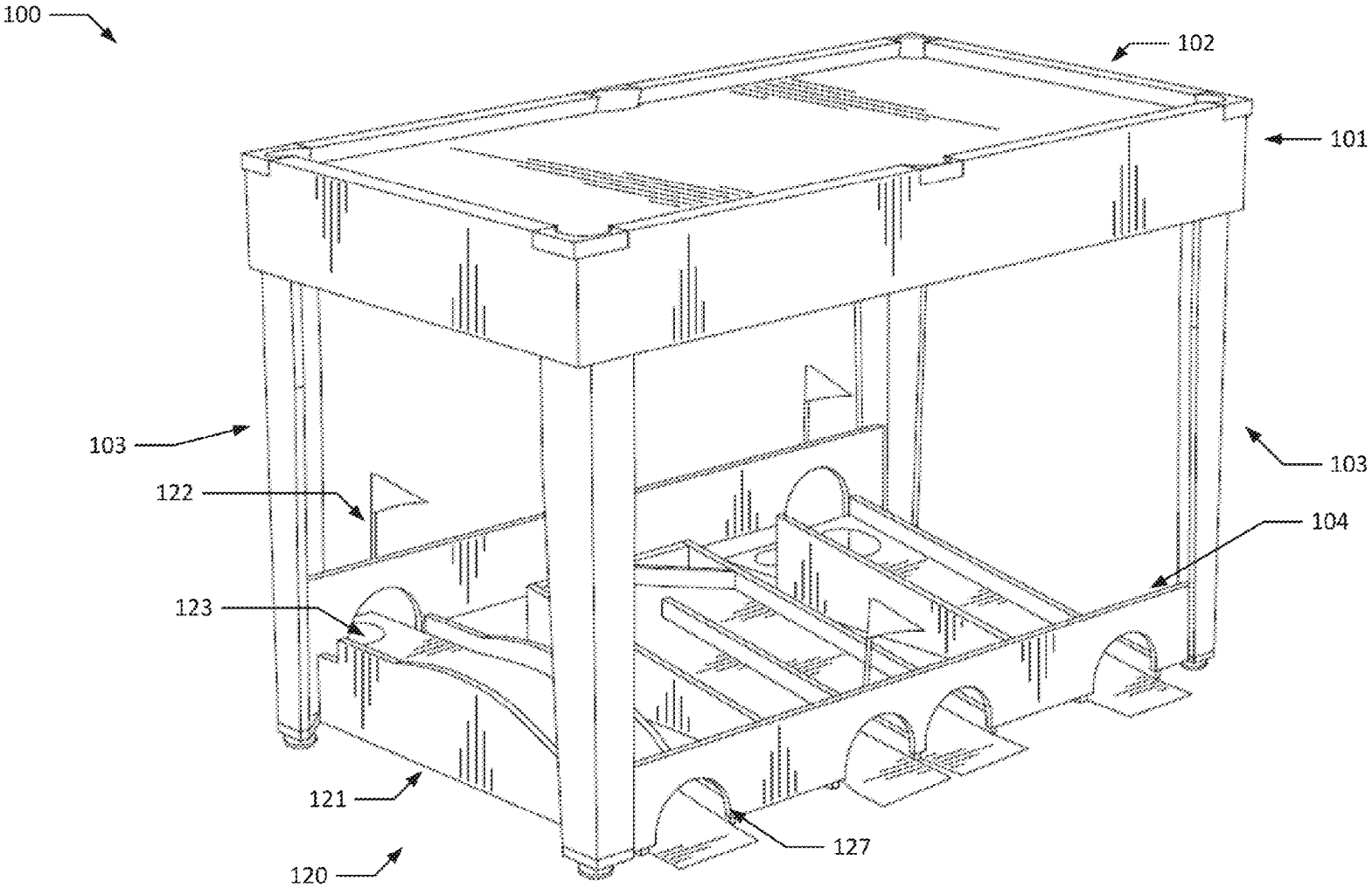
FIG. 1 shows a diagram of an example multi-game table, according to an example embodiment of the present disclosure.

As used herein, the surface panel can be configured for a table game. While FIG. 1 illustrates the surface panel configured for billiards, the surface panel can be likewise configured for any number of table games. For example, the surface panel can be configured for at least one of billiards, foosball, bumper billiards, air hockey, table tennis, target toss, pinball soccer, finger football, bowling, chess, checkers, Chinese checkers, backgammon, basketball toss, football toss, and bean bag toss, etc.

As used herein, a miniature golf course includes at least one miniature golf hole. Each miniature golf hole on the miniature golf course has its own course layout, with its own cup. Each miniature golf hole can have additional features along the golf hole itself (e.g., water hazards, stationary physical hazards, moving physical hazards, various surface textures, physical changes in slope and elevation, etc.) to mimic an actual golf hole (e.g., tee-box, fairway, rough, green, sand traps, water hazards, trees, windmills, etc.). Additionally, each miniature golf hole has a cup. For each miniature golf hole, the user attempts to hit a ball into the cup (e.g., using a golf putter). While certain miniature golf holes are disclosed herein, it should be appreciated that the example multi-game table may include any number or configuration of miniature golf holes. Additionally, in some embodiments, the miniature golf holes may be configurable or adjustable by a user by changing a hole layout, combining holes, placing holes at different elevations, etc.

Referring now to the figures, FIG. 1 shows a diagram of an example multi-game table, according to an example embodiment of the present disclosure. In one example embodiment, a table game apparatus 100 includes a table 101 with a surface panel 102. The surface panel 102 is configured for a table game (e.g., billiards). The table game apparatus 100 additionally includes a plurality of table legs 103. Each of the plurality of table legs 103 has a top end and a bottom end. The top end of each table leg 103 is connected to the table 101. The bottom end of each table leg 103 is configured to contact a floor. The table game apparatus 100 additionally includes a cross support beam 104 including a first end and a second end. The first end of the cross support beam 104 is connected to one of the table legs 103. The second end of the cross support beam 104 is connected to another of the table legs 103.

The table game apparatus 100 additionally includes a miniature golf course 120. The miniature golf course 120 is located underneath the table 101 and is configured to contact the floor. The miniature golf course 120 includes a miniature golf hole 121. The miniature golf hole 121 includes a cup 123. Additionally, a miniature golf flag 122 can be connected to the cross support beam 104 above a location of the cup 123 for the miniature golf hole 121. The miniature golf hole 121 is configured such that a portion of the cross support beam 104 is an element or feature of the miniature golf hole 121. The portion of the cross support beam 104, which is an element of the miniature golf hole 121, is a window 127. In an example embodiment, the window 127 is one of semi-circular, circular, triangular, rectangular, and square.

Figure 2:
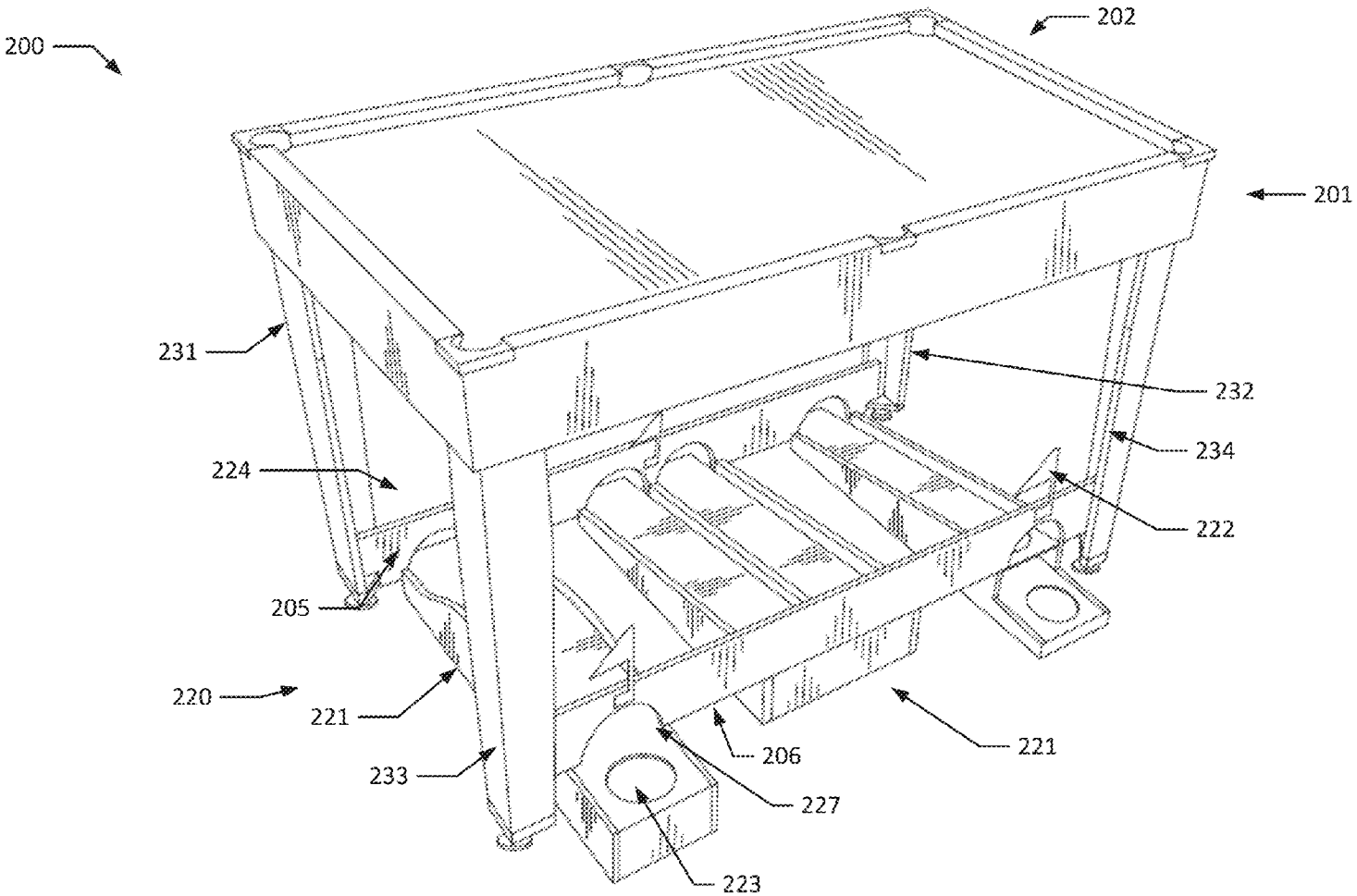
FIG. 2 shows an alternate view of a diagram of an example multi-game table, according to an example embodiment of the present disclosure.

FIG. 2 shows an alternate view of a diagram of an example multi-game table, according to an example embodiment of the present disclosure. In one example embodiment, the table game apparatus 200 includes a table 201 with a surface panel 202. The table 201 has a rectangular shape. The surface panel 202 is configured for a table game (e.g., billiards). The table game apparatus 200 additionally includes four table legs 231, 232, 233, and 234. Each of the four table legs 231, 232, 233, and 234 is located at a corner of the rectangular table. Each of the four table legs 231, 232, 233, and 234 has a top end and a bottom end. The top end of each table leg is connected to the table 201. The bottom end of each table leg is configured to contact a floor.

The table game apparatus 200 additionally includes a first cross support beam 205 including a first end and a second end. The first end of the first cross support beam 205 is connected to the first table leg 231. The second end of the first cross support beam 205 is connected to the second table leg 232. The table game apparatus 200 additionally includes a second cross support beam 206 including a first end and a second end. The first end of the second cross support beam 206 is connected to the third table leg 233. The second end of the second cross support beam 206 is connected to the fourth table leg 234.

The table game apparatus 200 additionally includes a miniature golf course 220. The miniature golf course 220 is located underneath the table 201 and is configured to contact the floor. The miniature golf course 220 includes a plurality of miniature golf holes 221. Each miniature golf hole 221 includes a cup 223. Additionally, a miniature golf flag 222 can be connected to a cross support beam (e.g., the second cross support beam 206) above a location of the cup 223 for the miniature golf hole 221.

The miniature golf hole 221 is configured such that a portion of a cross support beam (e.g., the second cross support beam 206) is an element of the miniature golf hole 221. The portion of the cross support beam 206, which is an element of the miniature golf hole 221, is a window 227. Each cross support beam (e.g., 205, 206) can have a window (e.g., 227) for each miniature golf hole 221. In an example embodiment, the windows vary in shapes and sizes, from golf hole to golf hole. In an example embodiment, the miniature golf hole 221 includes a starting tee 224 in proximity to a portion of the first cross support beam 205 and a cup 223 in proximity to the second cross support beam 206. In a different example embodiment, the miniature golf hole 221 includes a starting tee 224 in proximity to a portion of the second cross support beam 206 and a cup 223 in proximity to the first cross support beam 205. In a different example embodiment, the miniature golf hole 221 includes a starting tee 224 and a cup 223 in proximity to the same cross support beam (e.g., the first cross support beam 205) (i.e., a rolling configuration). In a different example embodiment, the miniature golf hole 221 is entirely disposed between the first cross support beam 205 and the second cross support beam 206.

Figure 3:
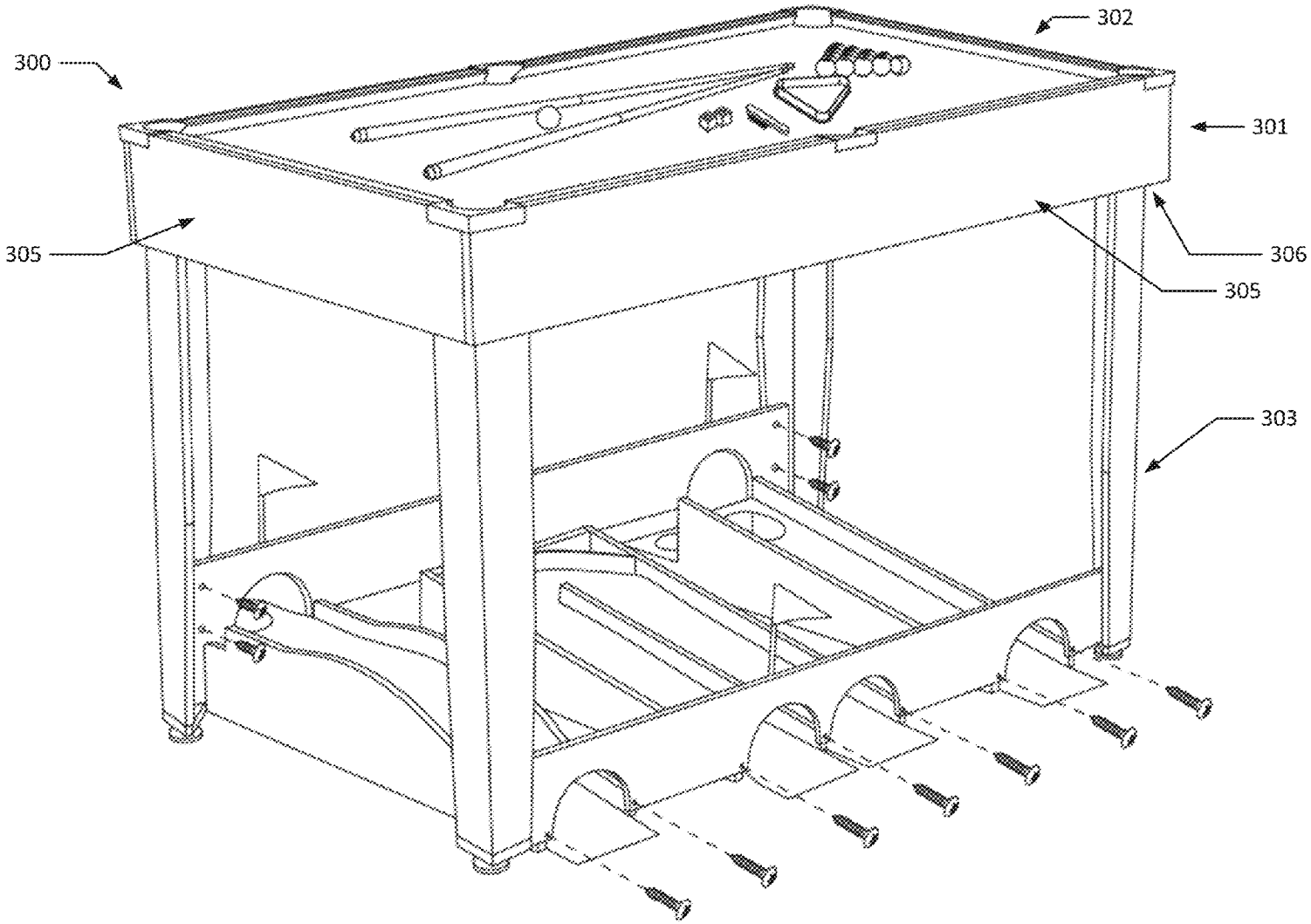
FIG. 3 shows an exploded-view of a diagram of an example multi-game table, according to an example embodiment of the present disclosure.

FIG. 3 shows an exploded-view of a diagram of an example multi-game table, according to an example embodiment of the present disclosure. In one example embodiment, the table game apparatus 300 includes a table 301 with a surface panel 302. The table 301 further includes a plurality of side panels 305. A face of each of the plurality of side panels 305 abuts an edge of the surface panel 302. The table game apparatus 300 additionally includes a plurality of table legs 303. Each of the plurality of table legs 303 has a top end and a bottom end. The top end of each table leg 303 is connected to at least one face of one of the plurality of side panels 305. The bottom end of each table leg 303 is configured to contact a floor. In an example embodiment, each of the plurality of table legs 303 is disposed in a corner formed by two of the plurality of side panels 305. In this embodiment, each of the plurality of table legs 303 is fastened to the face of each of the two side panels 305 forming the corner. Fastening can be done by any means known in the art (e.g., screws, nails, staples, rivets, dowels, glue, etc.).

Figure 4:
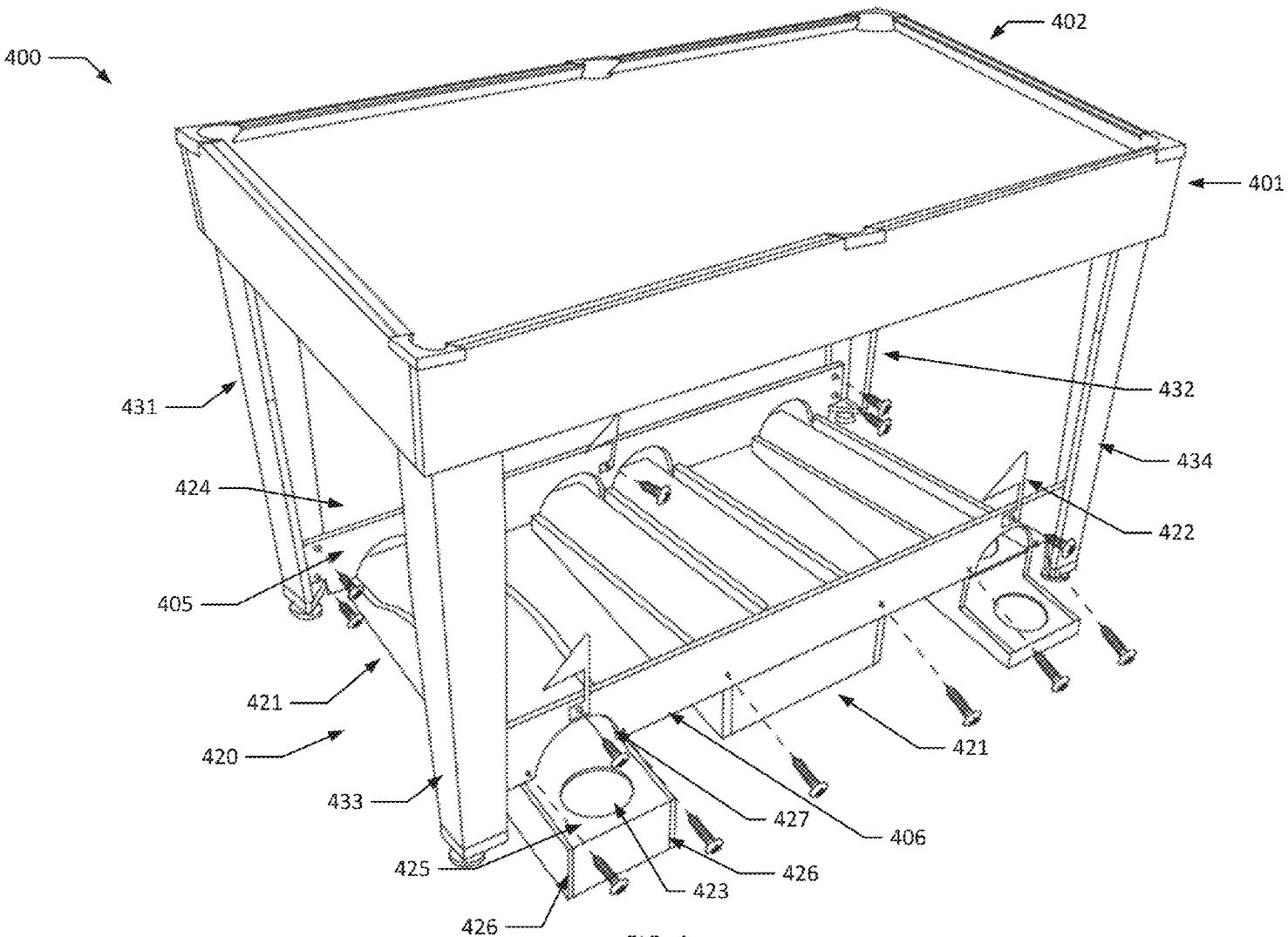
FIG. 4 shows an alternate exploded-view of a diagram of an example multi-game table, according to an example embodiment of the present disclosure.

FIG. 4 shows an alternate exploded-view of a diagram of an example multi-game table, according to an example embodiment of the present disclosure. In one example embodiment, a table game apparatus 400 includes a table 401 with a surface panel 402. The surface panel 402 is configured for a table game (e.g., billiards). The table game apparatus 400 additionally includes four table legs 431, 432, 433, and 434. Each of the four table legs 431, 432, 433, and 434 is located at a corner of the table 401. Each of the four table legs 431, 432, 433, and 434 has a top end and a bottom end. The top end of each table leg is connected to the table 401. The bottom end of each table leg is configured to contact a floor.

The table game apparatus 400 additionally includes a first cross support beam 405 including a first end and a second end. The first end of the first cross support beam 405 is connected to the first table leg 431. The second end of the first cross support beam 405 is connected to the second table leg 432. The table game apparatus 400 additionally includes a second cross support beam 406 including a first end and a second end. The first end of the second cross support beam 406 is connected to the third table leg 433. The second end of the second cross support beam 406 is connected to the fourth table leg 434.

The table game apparatus 400 additionally includes a miniature golf course 420. The miniature golf course 420 is located underneath the table 401 and is configured to contact the floor. The miniature golf course 420 includes a plurality of miniature golf holes 421. Each miniature golf hole 421 includes a cup 423. Additionally, a miniature golf flag 422 can be connected to a cross support beam (e.g., the second cross support beam 406) above a location of the cup 423 for the miniature golf hole 421. Each miniature golf hole 421 is configured such that a portion of a cross support beam (e.g., the second cross support beam 406) is an element of the miniature golf hole 421. The portion of the cross support beam 406, which is an element of the miniature golf hole 421, is a window 427. Each miniature golf hole 421 includes a starting tee 424 in proximity to a portion of the a cross support beam (e.g., the first cross support beam 405).

In an example embodiment, each miniature golf hole 421 additionally includes a golf top panel 425 including the cup 423, being a hole in the golf top panel 425, and at least two golf side panels 426. A face of each golf side panel 426 abuts an edge of the golf top panel 425. Furthermore, each of the at least two golf side panels 426 is at least partially disposed between the first cross support beam 405 and the second cross support beam 406. In a related example embodiment, an edge of each of the two golf side panels 426 is fastened to the face of a cross support beam (e.g., the second cross support beam 406). Fastening can be done by any means known in the art (e.g., screws, nails, staples, rivets, dowels, glue, etc.).

Figure 5:
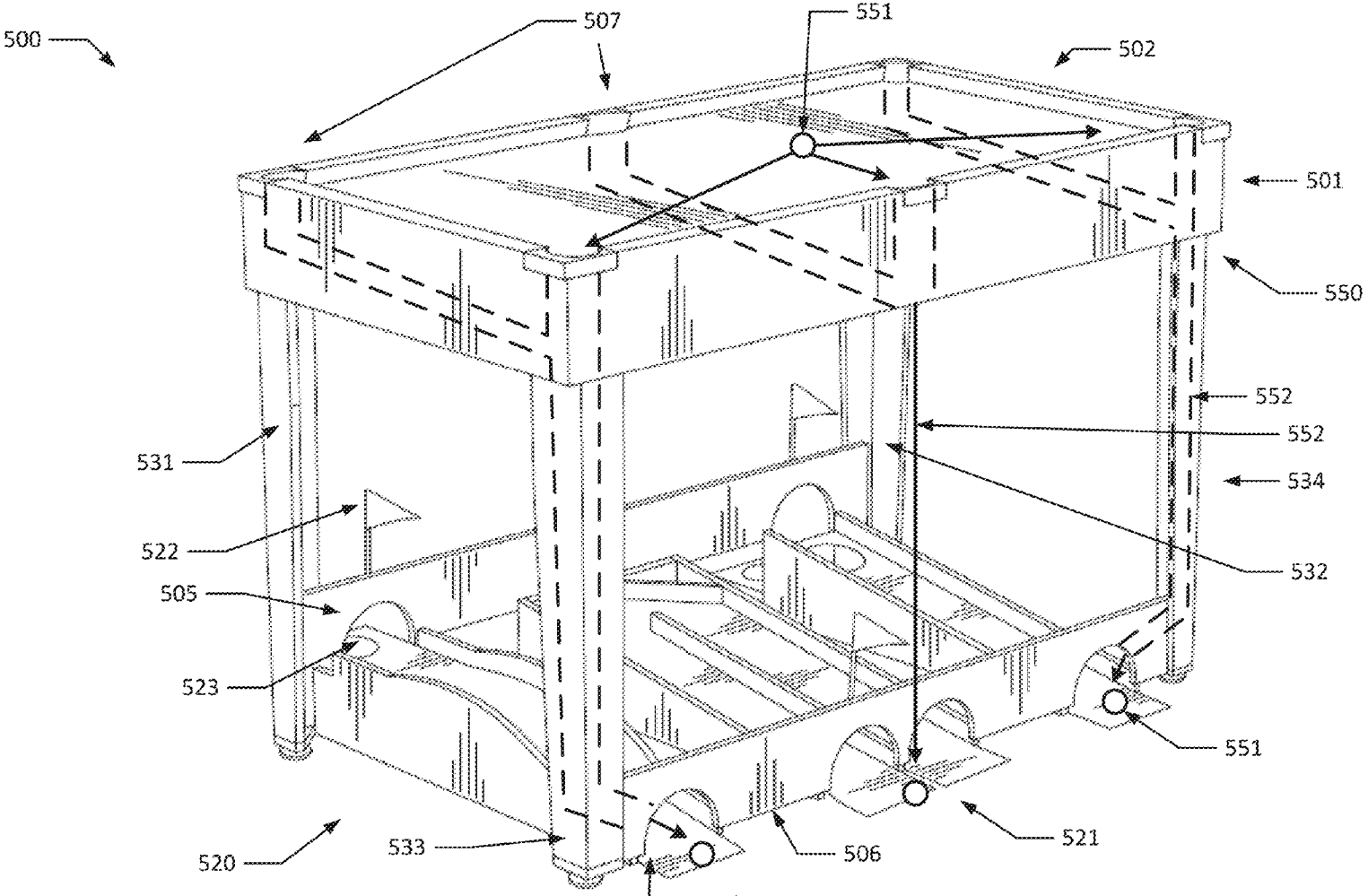
FIG. 5 shows a diagram of an example multi-game table, according to a different example embodiment of the present disclosure.

FIG. 5 shows a diagram of an example multi-game table, according to a different example embodiment of the present disclosure. In one example embodiment, the table game apparatus 500 includes a table 501 with a surface panel 502. The table 501 has a rectangular shape. The surface panel 502 is configured for a table game (e.g., billiards). The surface panel additionally has a plurality of table holes 507 (e.g., billiards pockets).

The table game apparatus 500 additionally includes four table legs 531, 532, 533, and 534. Each of the four table legs 531, 532, 533, and 534 is located at a corner of the rectangular table. Each of the four table legs 531, 532, 533, and 534 has a top end and a bottom end. The top end of each table leg is connected to the table 501. The bottom end of each table leg is configured to contact a floor.

The table game apparatus 500 additionally includes a first cross support beam 505 including a first end and a second end. The first end of the first cross support beam 505 is connected to the first table leg 531. The second end of the first cross support beam 505 is connected to the second table leg 532. The table game apparatus 500 additionally includes a second cross support beam 506 including a first end and a second end. The first end of the second cross support beam 506 is connected to the third table leg 533. The second end of the second cross support beam 506 is connected to the fourth table leg 534.

The table game apparatus 500 additionally includes a miniature golf course 520. The miniature golf course 520 is located underneath the table 501 and is configured to contact the floor. The miniature golf course 520 includes a plurality of miniature golf holes 521. Each miniature golf hole 521 includes a cup 523. Additionally, a miniature golf flag 522 can be connected to a cross support beam (e.g., the first cross support beam 506) above a location of the cup 523 for the miniature golf hole 521.

The miniature golf hole 521 is configured such that a portion of a cross support beam (e.g., the second cross support beam 506) is an element of the miniature golf hole 521. The portion of the cross support beam 506, which is an element of the miniature golf hole 521, is a window 527. In an example embodiment, the window 527 is one of semi-circular, circular, triangular, rectangular, and square. In an example embodiment, the miniature golf hole 521 includes a starting tee 524 in proximity to a portion of the second cross support beam 506 and a cup 523 in proximity to the first cross support beam 505.

In an example embodiment, the table game apparatus 500 also includes a ball delivery system 550. The ball delivery system 550 includes a chute 552. The chute 552 is disposed below one of the plurality of table holes 507. The chute 552 is in communication with both the one of the plurality of table holes 507 and a location below the surface panel 502. In an example embodiment, the location below the surface hole is associated with a particular position on the miniature golf course 520. When a ball 551 enters a table hole 507 from the surface panel 502, the ball 551 is sent, by the chute 552, to the miniature golf course 520. In a preferred example embodiment, the ball 551 is sent, by the chute 552, to the starting tee 524 of a miniature golf hole 521 on the miniature golf course 521. Ball travel is dictated by gravity: as the chute is in communication with a location below the surface panel 502, the ball travels in a downward direction toward the location below the surface panel 502. In other example embodiments, ball travel can be facilitated through a motorized track, spring loaded force, magnetism, electro-magnetism, or any other force means to move the ball from one of the plurality of table holes 507 to the location below the surface panel 502.

In a related example embodiment, the chute 552 is disposed within at least one of the four table legs 531, 532, 533, and 534. In a similarly related example embodiment, a chute 552 is disposed within each of the four table legs 531, 532, 533, and 534. In another similarly related example embodiment, an individual chute 552 is disposed below each of the plurality of table holes 507, such that an individual chute 552 is associated with an individual table hole 507. In yet another similarly related example embodiment, different chutes (e.g., an individual chute 552 associated with an individual table hole 507) can send the ball 551 to different miniature golf holes 521 of the miniature golf course 520, or different locations on an individual miniature golf hole 521 (e.g., the starting tee 524, the cup 523, a location between the starting tee 524 and the cup 523, etc.).

Figure 6:
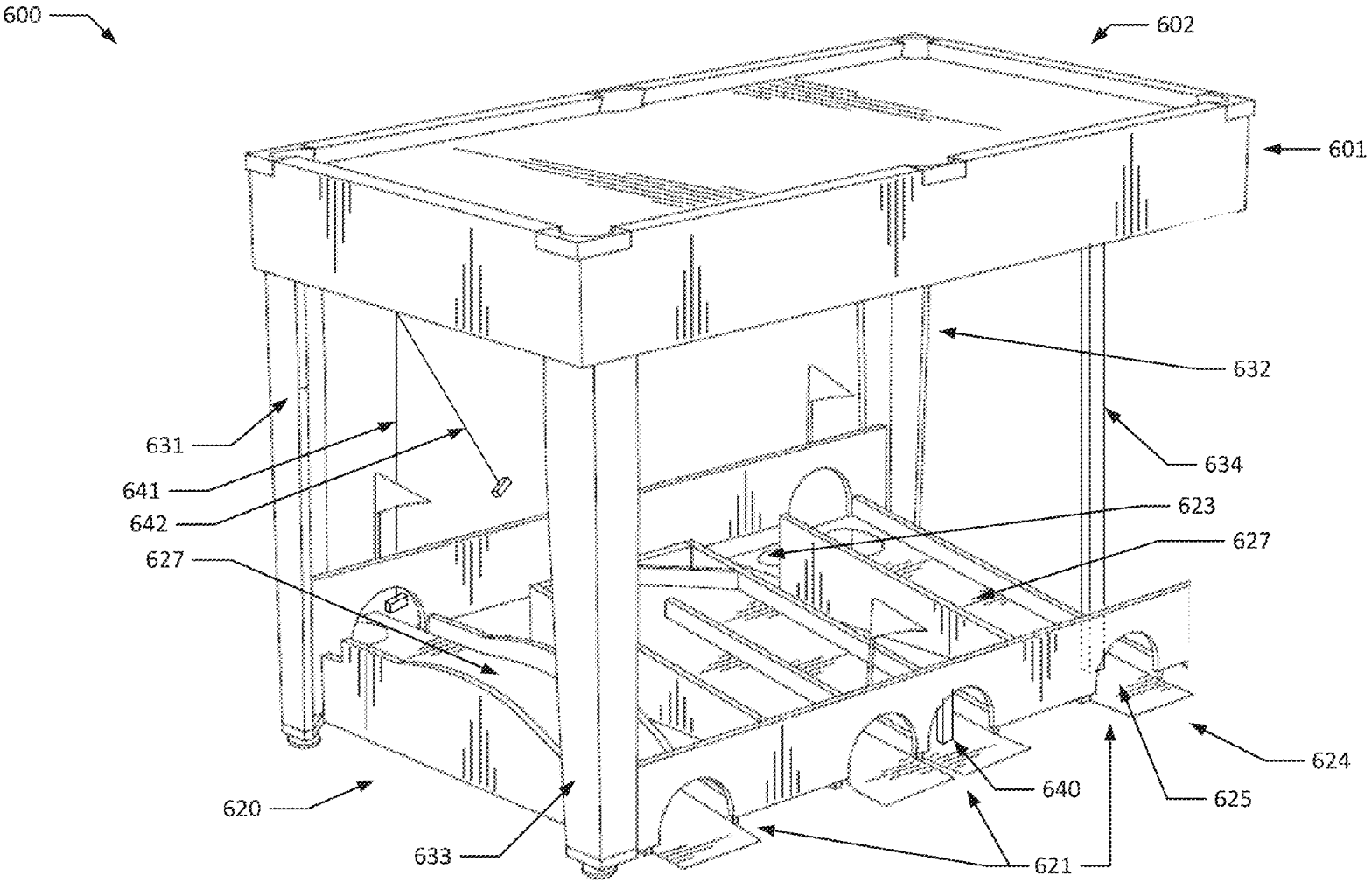
FIG. 6 shows a diagram of an example multi-game table, according to a different example embodiment of the present disclosure.

FIG. 6 shows a diagram of an example multi-game table, according to a different example embodiment of the present disclosure. In one example embodiment, a table game apparatus 600 includes a table 601 with a surface panel 602. The surface panel 602 is configured for a table game (e.g., billiards). The table game apparatus 600 additionally includes four table legs 631, 632, 633, and 634. Each of the four table legs 631, 632, 633, and 634 is located at a corner of the table 601. Each of the four table legs 631, 632, 633, and 634 has a top end and a bottom end. The top end of each table leg is connected to the table 601. The bottom end of each table leg is configured to contact a floor.

The table game apparatus 600 additionally includes a miniature golf course 620. The miniature golf course 620 is located underneath the table 601 and is configured to contact the floor. The miniature golf course 620 includes a plurality of miniature golf holes 621. Each miniature golf hole 621 includes a cup 623 and a starting tee 624. Each miniature golf hole 621 additionally includes a golf top panel 625 including the cup 623, being a hole in the golf top panel 625, and at least two golf side panels 626. A face of each golf side panel 626 abuts an edge of the golf top panel 625. Furthermore, each of the at least two golf side panels 626 is at least partially disposed between a plurality of cross support beams.

In an example embodiment, the golf top panel 625 includes an elevation change 627 configured to be one of a rise, a fall, a hill, a valley, a sheer drop, a rolling configuration, and some combination thereof. Each miniature golf hole 621 can have a different elevation change 627, which may be adjustable by a user. Each miniature golf hole can have additional features along the golf hole itself (e.g., water hazards, stationary physical hazards, moving physical hazards, various surface textures, physical changes in slope and elevation, etc.) to mimic an actual golf hole (e.g., tee-box, fairway, rough, green, sand traps, water hazards, trees, windmills, etc.). By employing different features (elevation changes and additional features) to different miniature golf holes 621, the golf course 620 provides the user with added variety. The user may find certain holes to be more challenging than others.

In a related example embodiment, at least one of the four table legs (e.g., the fourth table leg 634) intersects the miniature golf hole 621, such that the table leg 634 blocks a portion of the miniature golf hole 621. In this example embodiment, the table leg 634 acts as a stationary physical hazard for the miniature golf hole 621. The user is forced to "putt" around the table leg 634 in order to reach the cup 623. The table leg 634 can be designed, both physically and graphically to look like a boulder, tree, house, person, windmill, or other physical object that might typically be found on a golf course.

In a different related example embodiment, a stationary physical hazard 640 is attached to the cross support beam. This stationary physical hazard 640 blocks a portion of the miniature golf hole 621 from the user, such that the user is forced to "putt" around the stationary physical hazard 640 to reach the cup 623. Stationary physical hazard 640 can be attached to any of the cross support beams or any location on the table, for use with any of the miniature golf holes. In an example embodiment, stationary physical hazards 640 can be removed, and reattached, to any location on the table 601 or any of the cross support beams. In this way, the user can continually modify the hazards for a given hole, making any hole easier or more difficult. Stationary physical hazards (e.g., 640) can be designed, both physically and graphically to look like a boulder, tree, house, person, windmill, or other physical object that might typically be found on a golf course.

In another different related example embodiment, a stationary physical hazard 641 is attached to the table 601. This stationary physical hazard 641 blocks a portion of the miniature golf hole 621 from the user, such that the user is forced to "putt" around the stationary physical hazard 641. Alternatively, the stationary physical hazard 641 can be physically put into motion by the user, thus becoming a moving physical hazard 642. In an example embodiment, the moving physical hazard 642 includes a blocker and an arm, attached to the table 601, such that the moving physical hazard 642 swings as a pendulum. When swinging, the moving physical hazard 642 only blocks a portion of the miniature golf hole 621 from the user for a portion of time. In this way, the user must synchronize the "putt" to avoid hitting the moving physical hazard 642. In an example embodiment, the stationary physical hazard 641 and the moving physical hazard 642 can be removed, and reattached, to any location on the table 601 or any of the cross support beams. In this way, the user can continually modify the hazards for a given hole, making any hole easier or more difficult. While the moving physical hazard 642 is physically put into motion by the user, it should be appreciated that moving physical hazards can also be controlled and put into motion through other means (e.g., electric motors, electromagnetism, spring-loaded devices, remote control, etc.). Stationary physical hazards (e.g., 641) can be designed, both physically and graphically to look like a boulder, tree, house, person, windmill, or other physical object that might typically be found on a golf course. Moving physical hazards (e.g., 642) can be designed, physically and graphically to look like a person, animal, windmill, golf cart, or other physical moving object that might typically be found on a golf course.

Figure 7:
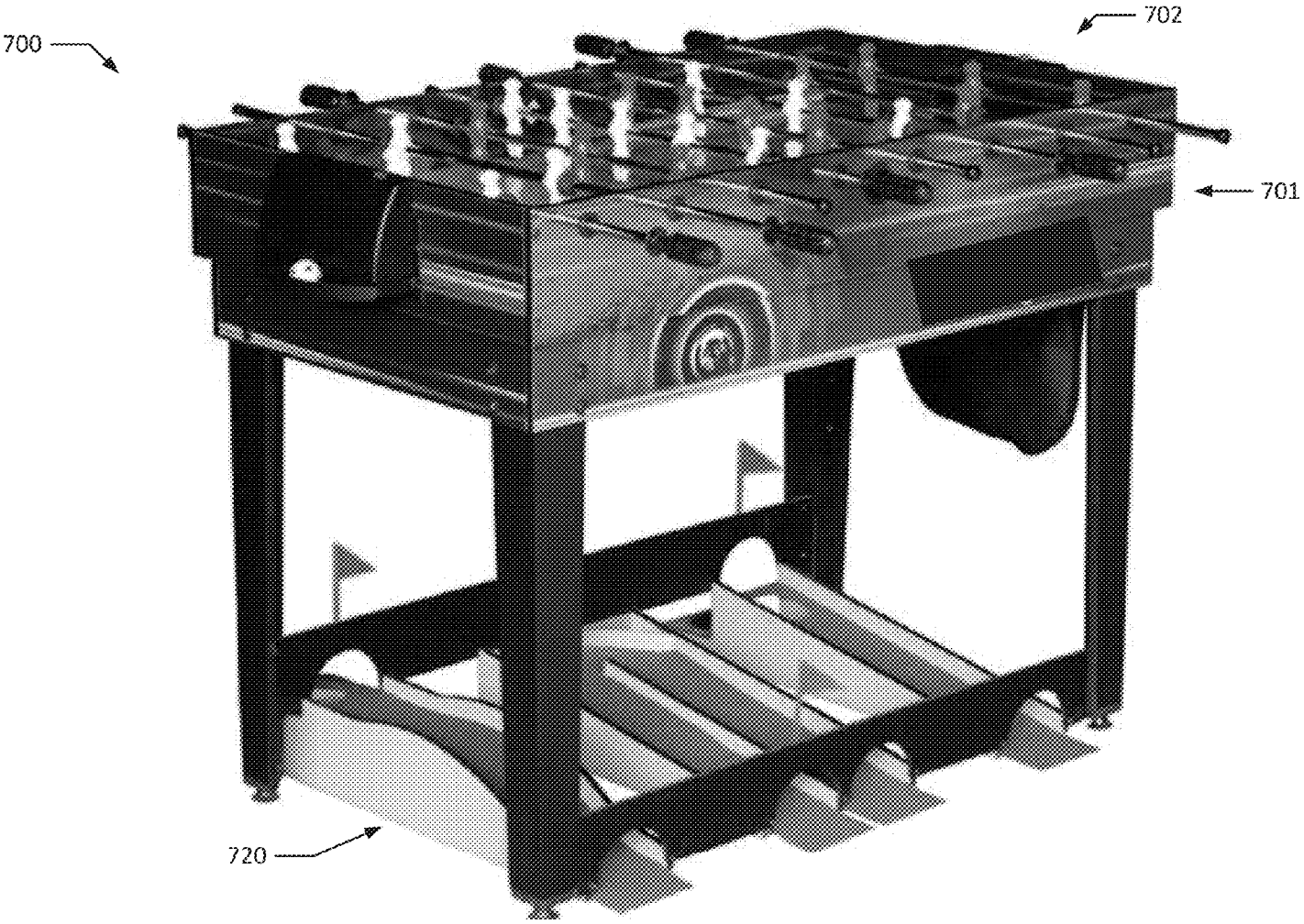
FIG. 7 shows a diagram of an example multi-game table, according to a different example embodiment of the present disclosure.

FIG. 7 shows a diagram of an example multi-game table, according to a different example embodiment of the present disclosure. In one example embodiment, a table game apparatus 700 includes a table 701 with a surface panel 702. The surface panel 702 is configured for a table game (e.g., foosball). The surface panel 702 can be configured for any number of table games, including billiards, foosball, bumper billiards, air hockey, table tennis, target toss, pinball soccer, finger football, bowling, chess, checkers, Chinese checkers, backgammon, basketball toss, football toss, and bean bag toss.

The table game apparatus 700 additionally includes a miniature golf course 720. The miniature golf course 720 is located underneath the table 701 and is configured to contact the floor.

Example Rules for the Multi-Game Table

It should be appreciated that different rules may be created for utilizing the surface panel and the miniature golf course to further enhance desirability and use by a user. In an example embodiment the surface panel is configured for billiards. The user is using a pool cue to "shoot" balls (e.g., pool balls) into various billiards pockets. Each ball shot into a pocket corresponds to a "point." Responsive to scoring a "point", the user can use a putter to "putt" a different ball (e.g., a golf ball) into one of the plurality of miniature golf holes on the miniature golf course. If the user "putts" the ball into a cup within a certain number of shots (e.g., three shots), also known as "par" for the hole, the user is awarded one additional bonus point. If the user "putts" the ball into the cup within a certain number of shots below par (e.g., two shots), the user is awarded more than one additional bonus point. If the user "putts" the ball into the cup within a certain number of shots above par (e.g., four shots), the user could lose points. Additionally, depending on how many shots it takes the user to "putt" the ball into the cup, rules can allow the user to play additional holes, to score additional points.

In an alternate example embodiment, a competitor may be able to "putt" the ball into a cup after the user; if the competitor beats the user's golf score, the user's initial "point" in the billiards game is cancelled out. With competitive play, moving physical hazards can likewise be controlled by a competitor. For example, the user can attempt to "putt" the ball, into the cup, while the competitor is simultaneously putting the moving physical hazard into motion (in an effort to block the cup from the user's "putt"). The user and competitor can then switch roles, such that the user puts the moving physical hazard into motion while the competitor "putts." In another alternate example embodiment, the user first "putts" on the miniature golf course to score points. Responsive to scoring a point, the user plays billiards (on the surface panel) to acquire additional points. This game, likewise, can implement the same competitor rules, as outlined above.

In a different example embodiment, the surface panel is configured for foosball. The user is using rods configured with soccer players to "shoot" balls (e.g., foosballs) into a soccer goal. Each goal scored corresponds to a "point." Responsive to scoring a "point", the user can use a putter to "putt" a different ball (e.g., a golf ball) into one of the plurality of miniature golf holes on the miniature golf course. It should be reemphasized that the surface panel can be configured for any number of table games, including billiards, foosball, bumper billiards, air hockey, table tennis, target toss, pinball soccer, finger football, bowling, chess, checkers, Chinese checkers, backgammon, basketball toss, football toss, and bean bag toss. Thus, any one of these table games can be used in combination with the miniature golf game. Regardless of the table game used, the miniature golf game can provided added opportunities for cross-play, cross-scoring, and competitive interactions.

In a different example embodiment, the combination game utilizes the ball delivery system to provide for interaction between the table game, as configured on the surface panel of the table, and the miniature golf course disposed below the table. For example, when the surface panel is configured for billiards, the user is using a pool cue to "shoot" balls into various billiards pockets. Each ball shot into a pocket corresponds to a "point." Utilization of the ball delivery system means that, responsive to the user shooting a ball into a pocket, the ball is sent, by a chute, to the miniature golf course. The user then has the opportunity to "putt" the ball into a cup of one of the miniature golf holes. If the user "putts" the ball into a cup on the first try, the user can get one additional bonus point. Alternate scoring options, including competitive scoring, can likewise be implemented as outlined above.

In a related example embodiment, ball delivery system has a chute for each table hole on the table (e.g., a separate chute for each billiards pocket). Each chute delivers a ball made from each chute's respective table hole (e.g., each billiard pocket) to the miniature golf course. Because there is a plurality of chutes, each chute can deliver the ball to a different location on the miniature golf course. For example, chutes can deliver balls to different miniature golf holes, or to different locations on the same miniature golf hole. This would add additional variety to the combination game. I.e., the user would prefer to shoot the ball into certain billiards pockets that send the ball to "easier" miniature golf holes or "easier" locations on a particular miniature golf hole; the user would avoid shooting the ball into certain billiards pockets that send the ball to "harder" miniature golf holes or "harder" locations on a particular miniature golf hole. Alternate scoring options, including competitive scoring, can likewise be implemented as outlined above.

In some examples, the chutes may include dividers or other elements that create a random path for the ball to drop onto the miniature golf course. The location of the path elements may be weighted such that a billiard ball that is shot into some table holes has a more likely chance of going into a miniature golf cup or being placed for an easier shot. Other table holes may be connected to chutes with dividers that produce a less likely chance of the ball rolling into a cup in the course below. This may cause the user of the billiards game to take a more difficult billiard shot with the hopes of getting an extra point from the ball then rolling into a cup on the miniature golf hole.

The example embodiments discussed above are only a small sampling of the possible creative options that the user can employ with the multi-game table. The user can create new rules, scoring systems, and entirely new games with the multi-game table. In this capacity, the multi-game table is constantly providing new enjoyment, excitement, and variety to the user.

Additional Embodiments of Floor-Level Games

While the above disclosure indicates that the table game apparatus 100, 200, 300, 400, 500, 600, and 700 of the respective figures includes the miniature golf course 120, 220, 420, 520, 620, and 720, it should be appreciated that the example table game apparatus may include other floor-level games. For example, the table game apparatus may include a skee ball game or bowling game in which a portion of the lane is supported by table legs or a cross support beam. In some instances, the table game apparatus includes a chute, tubing, and/or dividers that direct a ball from the surface panel to a hole or pins of the floor-level game. In these instances, the chute may be positioned to dispose a ball at the beginning of the lane. The acceleration of the ball gained from traveling through the chute may be used to cause the ball to roll down the lane and either knock over pins or go into a hole.

Other floor-level games may include a bag-toss game, a soccer-shot game, a hockey-shot game, a ball maze game, a labyrinth game, a dominos game, a domino show game, etc. It should be appreciated that support components of the table game apparatus including legs and cross support beams may be features/obstacles/ of any of the above mentioned games. The types and/or variations of the floor-level games are virtually limitless.

Aspects of the Example Multi-Game Table

Aspects of the subject matter described herein may be useful alone or in combination with one or more other aspects described herein. Without limiting the following description, in a first example aspect of the present disclosure, a table game apparatus comprises a table including a surface panel configured for a table game. The table game apparatus further comprises at least two table legs including a top end and a bottom end, the top end of each table leg connected to the table and the bottom end of each table leg configured to contact a floor. The table game apparatus further comprises a cross support beam including a first end and a second end, the first end connected to one of the table legs and the second end connected to another of the table legs. The table game apparatus further comprises a miniature golf course located underneath the table and configured to contact the floor, the miniature golf course including a miniature golf hole configured such that a portion of the cross support beam is an element of the miniature golf hole.

In accordance with another example aspect of the present disclosure, which may be used in combination with any one or more of the preceding aspects, the portion of the cross support beam includes a window.

In accordance with another example aspect of the present disclosure, which may be used in combination with any one or more of the preceding aspects, the window is at least one of semi-circular, circular, triangular, rectangular, and square.

In accordance with another example aspect of the present disclosure, which may be used in combination with any one or more of the preceding aspects, the table game apparatus further comprises a miniature golf flag connected to the cross support beam above a location of a cup for the miniature golf hole.

In accordance with another example aspect of the present disclosure, which may be used in combination with any one or more of the preceding aspects, the table has a rectangular shape. The table game apparatus further comprises four table legs each located at a corner of the rectangular table. The cross support beam is a first cross support beam configured to connect to a first and a second of the four table legs. The table game apparatus further comprises a second cross support beam configured to connect to a third and a fourth of the four table legs. The miniature golf hole further comprises a starting tee in proximity to a portion of the first cross support beam and a cup in proximity to the second cross support beam.

In accordance with another example aspect of the present disclosure, which may be used in combination with any one or more of the preceding aspects, the miniature golf course is entirely disposed between the first cross support beam and the second cross support beam.

In accordance with another example aspect of the present disclosure, which may be used in combination with any one or more of the preceding aspects, the surface panel is configured for at least one of billiards, foosball, bumper billiards, air hockey, table tennis, target toss, pinball soccer, finger football, bowling, chess, checkers, Chinese checkers, backgammon, basketball toss, football toss, and bean bag toss.

In accordance with another example aspect of the present disclosure, which may be used in combination with any one or more of the preceding aspects, the table further comprises a plurality of side panels, wherein a face of each of the plurality of side panels abuts an edge of the surface panel.

In accordance with another example aspect of the present disclosure, which may be used in combination with any one or more of the preceding aspects, each of the at least two table legs is connected to at least one face of one of the plurality of side panels.

In accordance with another example aspect of the present disclosure, which may be used in combination with any one or more of the preceding aspects, each of the at least two table legs is disposed in a corner, the corner formed by two of the plurality of side panels, and fastened to the face of each of the two side panels forming the corner.

In accordance with another example aspect of the present disclosure, which may be used in combination with any one or more of the preceding aspects, the miniature golf hole comprises a golf top panel, including the cup, wherein the cup is a hole in the golf top panel. The miniature golf hole further comprises at least two golf side panels, wherein a face of each of the two golf side panels abuts an edge of the golf top panel. Each of the two golf side panels is at least partially disposed between the first cross support beam and the second cross support beam.

In accordance with another example aspect of the present disclosure, which may be used in combination with any one or more of the preceding aspects, an edge of each of the two golf side panels is fastened to a face of the cross support beam.

In accordance with another example aspect of the present disclosure, which may be used in combination with any one or more of the preceding aspects, the golf top panel includes an elevation change that is one of a rise, a fall, a hill, a valley, a sheer drop, a rolling configuration, and some combination thereof.

In accordance with another example aspect of the present disclosure, which may be used in combination with any one or more of the preceding aspects, the miniature golf course includes a plurality of miniature golf holes.

In a second example aspect of the present disclosure, a table game apparatus comprises a rectangular table including a surface panel configured with a plurality of table holes. The table game apparatus further comprises four table legs, each including a top end and a bottom end, wherein the top end of each table leg is connected to the table and the bottom end of each table leg is configured to contact a floor. The table game apparatus further comprises a first cross support beam configured to connect to a first and a second of the four table legs. The table game apparatus further comprises a second cross support beam configured to connect to a third and a fourth of the four table legs. The table game apparatus further comprises a miniature golf course located underneath the table and configured to contact the floor. The miniature golf course includes a miniature golf hole, configured such that a portion of the cross support beam is an element of the miniature golf hole, and a starting tee in proximity to a portion of the first cross support beam and a cup in proximity to the second cross support beam.

In accordance with another example aspect of the present disclosure, which may be used in combination with any one or more of the preceding aspects, the portion of the cross support beam includes a window that is at least one of semi-circular, circular, triangular, rectangular, and square.

In accordance with another example aspect of the present disclosure, which may be used in combination with any one or more of the preceding aspects, at least one of the four table legs intersects the miniature golf hole, such that the table leg blocks a portion of the miniature golf hole.

In accordance with another example aspect of the present disclosure, which may be used in combination with any one or more of the preceding aspects, the table game apparatus further comprises a ball delivery system, wherein the ball delivery system comprises a chute, disposed below one of the plurality of table holes, wherein the chute is in communication with both the one of the plurality of table holes and a location below the surface panel.

In accordance with another example aspect of the present disclosure, which may be used in combination with any one or more of the preceding aspects, the chute is disposed within at least one of the four table legs.

In accordance with another example aspect of the present disclosure, which may be used in combination with any one or more of the preceding aspects, an individual chute is disposed below each of the plurality of table holes, such that each individual chute is associated with an individual table hole.

It should be understood that various changes and modifications to the example embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An apparatus, comprising:

a first game portion having an upper playing surface including a first hole formed on a first side of the first game portion and a second hole formed on an opposing second side of the first game portion, and a lower support surface;

a second game portion having an upper playing surface, and a lower support surface;

a plurality of support members connected to the first game portion, wherein the plurality of support members arrange the lower support surface of the first game portion at a spaced-apart-distance from the upper playing surface of the second game portion; and a chute having a first chute member disposed within one of the plurality of the support members, the first chute member having a first end in communication with the first hole of the upper playing surface and a second end in communication with the upper playing surface of the second game portion, and a second chute member extending from the first chute member and having a first end in communication with the second hole of the upper playing surface, wherein the second chute member provides communication between the second hole and the first chute member, wherein the upper playing surface of the first game portion includes a first playing field defining one or more of a billiard playing field, a foosball playing field, a bumper billiards playing field, an air hockey playing field, a table tennis playing field, a target toss playing field, a pinball soccer playing field, a finger football playing field, a bowling playing field, a chess playing field, a checkers playing field, a Chinese checkers playing field, a backgammon playing field, a basketball toss playing field, a football toss playing field, and a bean bag toss playing field, wherein the upper playing surface of the second game portion includes a second playing field defining a miniature golf course including at least one hole sized for receiving a ball, at least one flag, at least one hazard.

2. The apparatus of claim 1, further comprising:

a cross support beam that connects a first support member of the plurality of support members to a second support member of the plurality of support members.

3. The apparatus of claim 2, wherein the cross support beam includes a front surface and a rear surface, wherein the cross support beam is defined by a thickness extending between the front surface and the rear surface, wherein the cross support beam defines one or more windows that is/are sized for permitting passage of a ball there-through.

4. The apparatus of claim 1, wherein the first game portion further includes at least one side panel defining at least a portion of a perimeter of a first playing field of the upper playing surface of the first game portion, wherein the at least one side panel extends substantially perpendicularly away from the upper playing surface of the first game portion at an elevation.

5. The apparatus of claim 4, wherein the elevation of the at least one side panel is sized for mitigating a game piece from leaving the first playing field of the upper playing surface of the first game portion, wherein the at least one side panel includes at least one interruption for permitting the game piece to leave the first playing field of the upper playing surface of the first game portion, wherein the at least one interruption is aligned with the first end of the first chute member of the chute for permitting the game piece to:

leave the first playing field of the upper playing surface of the first game portion, enter the chute, travel in a downward direction through the chute, exit the chute at a second end of the first chute member, and arrive at a second playing field of the upper playing surface of the second game portion.

6. The apparatus of claim 5, wherein the second playing field is defined by a non-planar surface including one or more of a hill and a valley.

7. The apparatus of claim 1, wherein the second chute member is disposed below the upper playing surface of the first game portion.

8. The apparatus of claim 1, wherein the second chute member is arranged at an incline with respect to the upper playing surface of the first game portion.

* * * * *